United States Patent [19]

Grigorian et al.

[11] 4,304,428

[45] Dec. 8, 1981

[54] TAPERED SCREW JOINT AND DEVICE FOR EMERGENCY RECOVERY OF BORING TOOL FROM BOREHOLE WITH THE USE OF SAID JOINT

[76] Inventors: Samvel S. Grigorian, Universitetsky prospekt, 9, kv. 289; Mikhail I. Korabelnikov, ulitsa Nagornaya, 21, korpus 1, kv. 95; Jury M. Markov, M. Filevskaya ulitsa, 62, kv. 32; Alexandr A. Shakhnazahov, Bolshoi Balkansky pereulok, 5, kv. 14; Eduard A. Akopov, Leninsky prospekt, 150, kv. 47; Marina V. Kameneva, prospekt Vernadskogo, 99, korpus 1, kv. 244, all of Moscow, U.S.S.R.

[21] Appl. No.: 682,333

[22] Filed: May 3, 1976

[51] Int. Cl.[3] ..... F16L 15/00

[52] U.S. Cl. ..... 285/333; 175/302

[58] Field of Search ..... 175/302, 305, 300; 166/98; 173/139; 285/333, 334, DIG. 17, DIG. 24

[56] References Cited

U.S. PATENT DOCUMENTS

| | | | |
|---|---|---|---|
| 1,562,373 | 11/1925 | Sheldon | 285/DIG. 17 |
| 1,895,227 | 1/1933 | McCullough | 175/302 |
| 1,953,095 | 4/1934 | Baker | 285/333 X |
| 2,025,944 | 12/1935 | Fisher | 175/302 |
| 3,251,426 | 5/1966 | Lebourg | 175/302 X |
| 3,729,058 | 4/1973 | Roberts | 175/302 X |
| 3,942,824 | 3/1976 | Sable | 285/333 X |

FOREIGN PATENT DOCUMENTS

| | | | |
|---|---|---|---|
| 220568 | 4/1962 | Austria | 285/333 |

*Primary Examiner*—Thomas F. Callaghan
*Attorney, Agent, or Firm*—Burton L. Lilling

[57] ABSTRACT

A tapered screw joint with the thread profile whose bearing side is inclined at an angle of from about 86° to about 98° to the plane which is perpendicular to the thread axis.

Such a tapered screw joint of parts makes it possible to disconnect them rapidly and repeatedly under the effect of axial tensile loads with subsequent reconnection under the effect of an applied torque. This screw joint will be used most effectively in a device for the emergency recovery of the boring tool from a borehole.

5 Claims, 4 Drawing Figures

Figure 1:
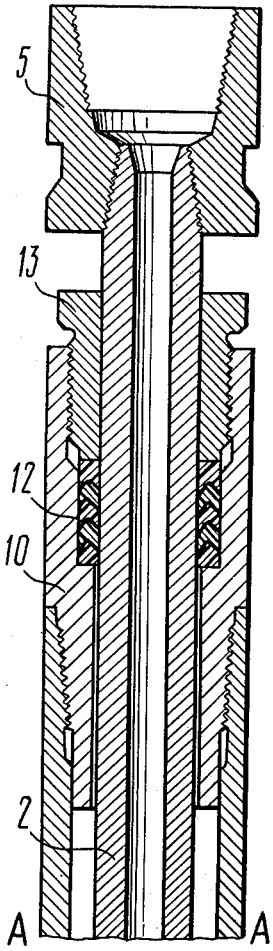
Figure 1:
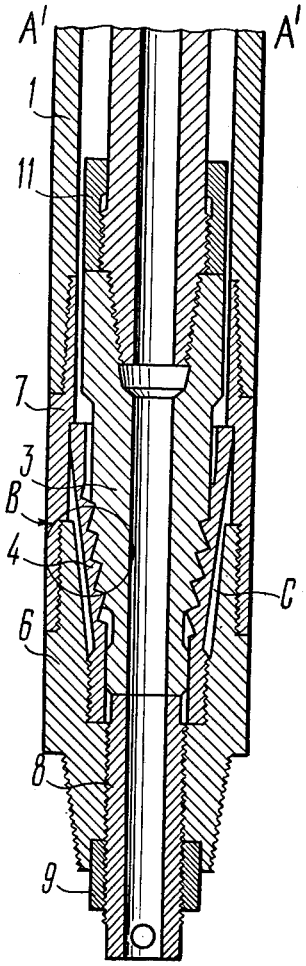

TAPERED SCREW JOINT AND DEVICE FOR EMERGENCY RECOVERY OF BORING TOOL FROM BOREHOLE WITH THE USE OF SAID JOINT

The present invention relates to machine building, and more specifically it relates to tapered screw joints of parts and to devices for the emergency recovery of the boring tool from boreholes with the use of said joint.

Widely known in the previous art are tapered screw joints with the thread profile formed by the conjugated sides set at an angle to each other, one of the sides being a bearing one.

Like in straight pipe threads, the bearing side of the profile in the known taper threads is inclined at an angle of 0° to 75° to the plane perpendicular to the thread axis.

Such tapered screw joints can be assembled and disassembled many times by rotating only one part relative to the other one and, consequently, by applying torque, which takes comparatively much time.

However, such joints cannot be used as quick-disconnect joints for instantaneous emergency disconnection of parts for example in boreholes, pipelines and other hard-to-get-at places because on application of axial tensile loads the bearing surface of the taper thread will be destroyed (sheared and crushed) thus rendering such a tapered screw joint unfit for further use.

An object of the present invention resides in providing a tapered screw joint of parts and a device for the emergency recovery of a boring tool from a borehole with the use of this joint whose thread profile would ensure repeated disconnection of the joint under the force of axial tensile loads.

Another object of the invention resides in providing a device for recovering the boring tool from the borehole with the use of the tapered screw joint whose thread profile would ensure transmission by said joint of strong torques, and its disconnection under heavy axial loads.

This object is achieved by providing a tapered screw joint of parts with the thread profile formed by the conjugated sides of the thread set at an angle to each other, one of the sides being a bearing one. According to the invention, the bearing side of the thread profile is inclined at an angle varying from about 86° to about 98° to a plane which is perpendicular to the thread axis.

Such a solution permits rapid and repeated disconnection of the tapered screw joint of parts by subjecting them to axial tensile loads and by assembling them subsequently under the effect of a torque.

This is achieved due to the fact that the bearing side of the thread profile at the above-mentioned angles of its inclination works in crushing (and not in shear as in the known tapered screw joints) so that with sufficient surface hardness such tapered screw joints of parts can be used repeatedly for disconnecting parts by subjecting them to axial tensile loads.

When the inclination angle of the bearing side of the taper thread varies from about 90° to about 98° (i.e. exceeding the right angle), the tapered screw joint is capable of transmitting torques similarly to the known tapered screw joints and be disconnected under light axial loads. Therefore such screw joints can be employed for rapid disconnection of parts transmitting heavy torques, e.g. in emergency couplings.

When the bearing side of the profile of the taper thread is inclined at the angles from about 86° to about 90° (i.e. smaller than the right angle) the tapered screw joint can transmit the same torques as the known joints and be disconnected at heavier axial loads; therefore such screw joints can be employed for rapid disconnection in the axial direction of the parts transmitting heavy torques and standing heavy axial loads.

Such type of the tapered screw joints can be used most effectively in the devices for emergency recovery of boring tools from boreholes.

Known in the previous art are devices for the emergency recovery of boring tools from the borehole, built into the drilling string (see, for example, Bowen Tools, Inc., General Catalog 1972–73, p. 627, Bowen Surface Jar) comprising a hollow body which accommodates a telescopically inserted hollow rod, both being kinematically linked with each other with a provision for their disconnection on application of axial tensile loads.

In these devices the kinematic linkage between the body and the rod comprises an adjustable collet joint consisting of a collet sleeve located in the conical part of the body, and a friction piston rigidly connected with the rod.

In case of the emergency, e.g. when the boring tool gets stuck in the borehole, the device is built into the drilling string between the driving pipe which transmits the torque from the rotor and is located above the borehole head, and the remaining part of the drilling string lowered into the borehole.

In this case the rod of the device is connected by means of an adapter bushing with the driving pipe while the body is connected by means of another adapter bushing with the remaining part of the drilling string.

Then internal tensile stresses are built up in the pipes by lifting the drilling string by a system of hoists until the collet joint is disconnected.

The collet sleeve goes down at a high speed so that the stress in the pipes of the drilling string drops to zero and said pipes are drawn into a vibratory process which frees the boring tool struck in the borehole.

One of the disadvantages of such devices for recovering the boring tool from the borehole lies in that the adjustable collet joints have to be protected against the material surrounding them in the borehole by, say, oil-filled housings in order to prevent the particles of hard material (drilling sludge, etc, from getting into these joints. As a result, the known devices are too complicated in design and comparatively unreliable.

Another disadvantage of the known device lies in that the adjustment of the force required for disconnecting the collet joint is difficult since it is carried out by a side screw located outside the borehole.

Besides, each of the known devices can act on the boring tool stuck in the borehole in one direction only, i.e. from top to bottom or vice versa, therefore the drilling site has to be equipped with two devices simultaneously which is unprofitable.

According to the invention, in the device for emergency recovery of the boring tool from the borehole the end of the rod located in the body carries a rigidly installed coaxial inner conical bushing with an external taper thread while the body accommodates an outer conical bushing which envelops the inner bushing and has a matching internal taper thread which, together with the taper thread of the inner conical bushing, forms a tapered screw joint with the thread profile whose bearing side is inclined at an angle of from 88°30′ to 89°40′ to the plane perpendicular to the thread axis, the outer conical bushing being thin-walled and set so as to form a circular clearance between said bushing and the body, said clearance extending throughout the length of said tapered screw joint.

Such an arrangement makes it possible to dispense with the means for protecting the unit which ensures kinematic linkage between the body and the rod of the device thereby simplifying its design and stepping up its reliability.

It is practicable that the device should be built into a drilling string by means of two adapter bushings one of which is rigidly secured on the end of the rod protruding from the body, while the other one is secured on the opposite end of the body and serves for fastening the outer conical bushing in said body, the axial hole in said bushing being threaded and receiving an adjusting screw whose end interacts with the end of the inner conical bushing while it is moved relative to the outer conical bushing in order to change the area of the matching surfaces of their tapered screw joint.

Such a solution provides for a wide range of adjustments of the axial forces required for disconnecting the tapered screw joint and thus adds to the versatility of the device since it ensures also a wide range of adjustment of the force and frequency of the blows dealt to the element of the drilling string stuck in the borehole.

According to one of the embodiments of the invention, the other adapter bushing carries a rigidly secured coaxial damping piston which covers the circular clearance between the outer surface of the body and the borehole walls.

This arrangement allows the device to be used for creating a pulse-wave effect on the element of the drilling string stuck in the borehole, since in this case the damping piston takes the weight of the liquid contained in the upper part of the circular clearance between the borehole walls and the body and creates a hydrodynamic effect thereby excluding the recoil of the hoisting devices.

It is practicable that the outer conical bushing should be made of a metal with a higher elasticity than that of the metal of the inner conical bushing.

This solution ensures reliability of the outer conical bushing and of the device as a whole during its repeated employment.

To extend the service life of the device the bearing side of the profile of the taper thread on both conical bushings may be surface-hardened.

Figure 2:
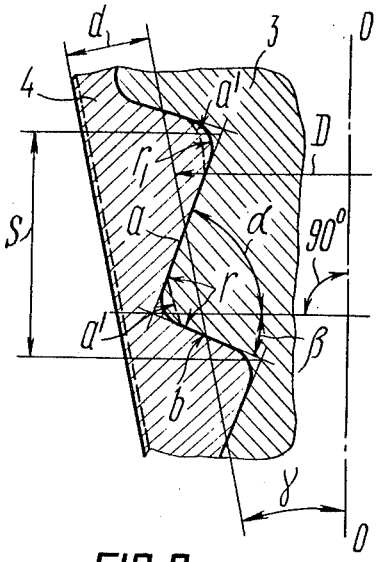
Figure 3:
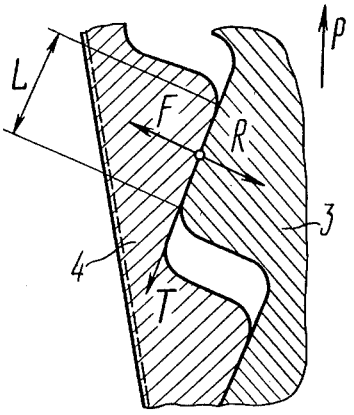
Figure 4:
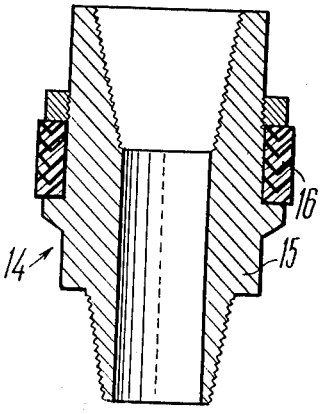

Given below is a description of one of the possible embodiments of the invention with reference to the accompanying drawings in which FIG. 1 is a schematic longitudinal section with a cross-sectional parting line taken along line A—A of the device for emergency recovery of a boring tool from a borehole with the use of a tapered screw joint of parts according to the invention;

FIG. 2 shows an enlarged fragmented view of the section "B" in FIG. 1 and designates the geometrical elements of the tapered screw joint of parts according to the invention, enlarged;

FIG. 3—same as in FIG. 2 with the tapered screw joint working under load;

FIG. 4 is a longitudinal section through the damping piston.

The device for the recovery of a boring tool from a borehole in an emergency situation (sticking of the tool in the borehole) comprises a hollow cylindrical body 1 (FIG. 1) accommodating a telescopically-installed hollow rod 2 which, according to the invention, is linked kinematically with said body by a tapered screw joint.

The end of the rod 2 accommodated in the body 1 carries a rigidly installed coaxial inner conical bushing with an external taper thread, said bushing being made in the form of a nipple 3, while the body 1 accommodates a rigidly secured outer conical bushing in the form of a friction coupling 4 enveloping the nipple 3 and provided with a matching internal taper thread which, together with the thread of the nipple 3, forms a tapered screw joint.

According to the invention, this joint has a thread profile whose bearing side is inclined at an angle of from 88°30′ to 89°40′ to the plane which is perpendicular to the thread axis.

The device for the emergency recovery of the boring tool from the borehole is built into the drilling string (not shown in the drawing) with the aid of two adapter bushings 5 and 6 one of which (5) is rigidly secured on the upper end of the rod 2 protruding from the body, whereas the other one (6) is secured on the opposite (lower) end of the body 1 with the aid of an intermediate bushing 7.

The lower adapter bushing 6 and the intermediate bushing 7 also provide for fastening the conical friction coupling 4 in the body 1.

According to the invention, the axial hole in the lower adapter bushing 6 is threaded and receives a hollow adjusting screw 8 with a lock nut 9, the end of said screw 8 interacting with the end of the nipple 3 when the latter is moved axially relative to the coupling 4 for changing the area of the matching surfaces of the tapered screw joint between said coupling 4 and nipple 3.

Thus, the axial tensile forces for disconnection of the nipple 3 and coupling 4 are adjusted by turning the adjusting screw 8 in or out.

The upper end of the body 1 carries a bushing 10 which limits the travel of the rod 2 for which purpose the latter is provided, above the nipple 3, with a rigidly secured anvil 11 interacting with the bushing 10.

The circular clearance between the body 1 and the rod 2 is sealed by cups 12 placed into the recess of the bushing 10 and held in position by a nut 13.

The device also comprises a damping piston 14 (FIG. 4) in the form of a threaded bushing 15 with cups 16 secured on it. The damping piston 14 is fastened to the lower adapter bushing 6 and covers the circular clearance between the outer surface of the body 1 of the device and the borehole walls (not shown in the drawing).

All the joints of the device are threaded which facilitates its manufacture, disassembly and assembly.

The nipple 3 and the friction conical coupling 4 enveloping it form a screw pair with a pitch "S" (FIG. 2). The thread profile of the tapered screw joint of the nipple 3 and coupling 4 is formed by the sides "a" and "b" conjugated with each other at rounding radiuses "r" and "$r_1$" set at an angle $(\alpha+\beta)$ to each other, the larger of these sides being a bearing one.

According to the invention, the bearing side "a" of the profile of the taper thread is inclined to the plane perpendicular to the thread axis "0—0" at an angle $\alpha$ which is selected within the range from 88°30′ to 89°40′ depending on the pitch "S" of the taper thread, the material and the thickness "d" of the friction coupling 4.

The tapered screw joint of the nipple 3 and friction coupling 4 with such a thread profile can be used many times for the disconnection of these parts by subjecting them to axial tensile loads.

According to the invention, the coupling 4 is thin-walled and there is a circular clearance "c" between said coupling and the body 1 throughout the length of said screw joint, the metal of the coupling 4 being at least five times more elastic than that of the nipple 3.

It is practicable that the coupling 4 should be made of spring steel and the nipple 3, of any harder metal.

Such a solution makes it possible to increase substantially the reliability of the device and decrease its overall dimensions while retaining the preset tensile characteristics during repeated employment.

According to the invention, the bearing side "a" of the taper thread profile on the nipple 3 and coupling 4 is surface hardened to increase the service life of these parts.

All the characteristics, such as the average thickness "d" (FIG. 2) of the coupling 4 working in the zone of elastic deformations, pitch "S" of the taper thread, angles $\alpha$ and $\beta$ determining its profile, angle of thread $\gamma$, its pitch diameter "D", length of engagement, rounding radiuses r and $r_1$ are selected so as to ensure the possibility of adjusting the axial loads P (FIG. 3) and of using repeatedly the connected parts, namely the nipple 3 and coupling 4, while at the same time satisfying the relation $S \leqq \pi$ D.f where f—coefficient of friction between the coupling 4 and the nipple 3.

Actually, the angle $\beta$ is taken to be from 0° to 45° and the angle of thread $\gamma$ is selected on the basis of the relation $\gamma > 90° - \alpha$. The rounding radiuses r and $r_1$ of the taper thread profile are practically the same, being equal to 0.05 of the taper thread pitch "S".

The sides "a" and "b" at the crest of the taper thread of the nipple 3 and coupling 4 can be conjugated in the zone a' (FIG. 2) with a taper equal to the angle "$\gamma$" or even in the zone which is parallel to the thread axis, the recommended length of this zone not exceeding 0.1 of the thread pitch "S".

The device for the emergency recovery of the boring tool from the borehole functions as follows.

When the boring tool (drilling bit or drill pipe) gets stuck in an oil or gas well, the free part of the drill string is pulled out and the device complete with the damping piston (not Shown in FIG. 1) is built into said string. For this purpose the adapter bushing 5 and the piston are connected, respectively, with the upper and lower pipes of the free part of the drilling string and the latter is again lowered into the borehole where it is connected to the stuck boring tool by any methods and means known in the drilling technology.

The device is set to the initial position by rotating the drilling string so as to screw the nipple 3 all the way into the friction coupling until the lower end of the nipple comes to bear against the end of the adjusting screw 8.

Then the drilling string is strained by lifting it, e.g. by a system of hoists, which creates internal tensile stresses in the drilling string, said stresses being transmitted to the rod 1 of the device. Under the effect of the upward-directed axial tensile load "P" (FIG. 3) gradually arising in the rod 1 the latter starts moving upward and carries the nipple 3 together with it.

As a result, the following forces arise on the conjugated zone "L" of the bearing surfaces of the tapered screw joint between the nipple 3 and coupling 4: force "F" which is a radial component of the axial load "P" causing internal circular stresses in the coupling 4, force "R" of reaction of the coupling 4 directed opposite to the force "F" and force of friction "T" between said conjugated portions "L" of the bearing surfaces of the tapered screw joint which prevents free movement of the nipple 3 relative to the coupling 4 over the bearing surfaces of their tapered screw joint.

In this position the coupling 4 functions as a spring ring and the circular stresses arising in it do not go beyond the limit of elastic deformation, while at a sufficiently heavy axial load P, which must be greater that the projection of all the friction forces "T" on the thread axis "0—0", the coupling 4 and nipple 3 are disengaged.

When the forces of frictional adhesion between the nipple 3 and coupling 4 are exceeded, this breaks the connection between the rod 2 and the body 1 and the latter goes down. At this moment the tensile stresses in the drilling string drop very rapidly to zero and the string pipes are set into a vibratory mode which frees the tool stuck in the borehole.

To provide for a hard (jarring) blow on the boring tool stuck in the borehole, the device is built into the drilling string at a point located not farther than 1/20 of the free part of the string with the aid of the lower adapter bushing 6, in which case the damping piston 14 is canceled. After the breaking of the frictional adhesion between the nipple 3 and coupling 4 of the device, the rod 2 goes upward and the anvil 11 strikes a blow on the bushing 10 which conveys this blow through the body 1 to the tool stuck in the borehole thus freeing said tool.

For the second blow the rod 2 is turned together with the upper part of the drilling string until the nipple 3 comes to bear against the adjusting screw 8 and the system is screwed up with a torque which depends on the stiffness of the tapered screw joint between the coupling 4 and nipple 3 after which the drilling string is again strained. Then the above-described process is repeated over again.

In case of a wave action applied to the part of the drilling string stuck in the borehole, the damping piston 14 takes the weight of the liquid contained in the upper part of the circular gap in the borehole and causes a hydrodynamic effect, thus preventing the recoil of the load-hoisting devices.

Before acting on the stuck tool, the strained (stretched state of the drilling string is adjusted by means of the adjusting screw 8, the frictional adhesion of the nipple 3 to the coupling 4 increasing with the size of the area of the initial engagement of their tapered screw joint.

We claim:

1. A device for the emergency recovery of the boring tool from the borehole which is built into the drilling string and comprises: a hollow body; a hollow rod inserted telescopically into said body; an inner conical bushing with external taper thread, rigidly secured on the end of said rod accommodated in said body, coaxially with said rod; an outer conical bushing which is thin-walled, said outer conical bushing being secured in said body so as to form a circular clearance between said outer conical bushing and said hollow body and enveloping said inner conical bushing, said outer conical bushing further having a matching internal taper thread which, together with the outer taper thread of said inner conical bushing, forms a tapered screw joint between these bushings; the improvement consisting in that the tapered screw joint of said bushings has a thread profile and a bearing side which is inclined at an angle of from 88°30' to 89°40' to the plane perpendicular to the thread axis which provides for repeated disconnection of said body and rod under the effect of tensile loads and for subsequent connection thereof under the effect of an applied torque.

2. A device according to claim 1 which is built into the drilling string by means of two adapter bushings one of which is secured rigidly on the end of the rod protruding from the body while the other one is secured on the opposite end of the body and serves for fastening an outer conical bushing in said body, the axial hole in this adapter bushing being threaded and receiving a hollow adjusting screw whose end interacts with the end of the inner conical bushing as the latter is moved axially relative to the outer concial bushing for changing the area of the conjugated bearing surfaces of the tapered screw joint between said outer and inner bushings.

3. A device according to claim 2, wherein the other adapter bushing is provided with a rigidly secured coaxial damping piston which covers the circular clearance between the outer surface of the body and the borehole walls.

4. A device according to claim 1 wherein the outer conical bushing is made of a metal which is more elastic than that of the inner conical bushing.

5. A device according to claim 1, wherein said bearing side of the taper thread profile on each conical bushing is surface hardened.

* * * * *